US006231647B1

(12) United States Patent
Cheng

(10) Patent No.: US 6,231,647 B1
(45) Date of Patent: May 15, 2001

(54) VACUUM CLEANER

(76) Inventor: Han-Shim Cheng, Block B, 7/F., Luk Hop Ind. Bldg., No. 8 Luk Hop Street, San Po Kong, Kowloon (HK)

( * ) Notice: Subject to any disclaimer, the term of this patent is extended or adjusted under 35 U.S.C. 154(b) by 0 days.

(21) Appl. No.: 09/236,461

(22) Filed: Jan. 25, 1999

(51) Int. Cl.[7] ..... A47L 7/04; A47L 9/14; A47L 9/32

(52) U.S. Cl. ..... 96/226; 96/108; 96/134; 96/142; 15/344; 15/347

(58) Field of Search ..... 96/222, 108, 134, 96/142; 55/DIG. 3; 15/344, 347

(56) References Cited

U.S. PATENT DOCUMENTS

| | | | |
|---|---|---|---|
| 1,891,256 | * | 12/1932 | Bilde . |
| 2,103,049 | * | 12/1937 | Whitaker . |
| 2,598,129 | * | 5/1952 | MacFarland . |
| 2,896,761 | * | 6/1959 | Davidson . |
| 3,274,758 | * | 9/1966 | Parman . |
| 3,902,877 | * | 9/1975 | Swaim . |
| 4,554,698 | | 11/1985 | Rennecker et al. . |
| 4,617,157 | * | 10/1986 | Stein et al. . |
| 4,752,422 | * | 6/1988 | Uchida et al. . |
| 5,342,420 | | 8/1994 | Bosses . |
| 5,461,751 | | 10/1995 | Sepke . |
| 5,702,507 | * | 12/1997 | Wang . |

FOREIGN PATENT DOCUMENTS

| | | |
|---|---|---|
| 3740517A1 | 6/1989 | (DE) . |
| 4311258C1 | 6/1994 | (DE) . |
| 0174273A1 | 3/1986 | (EP) . |
| 2686010 | 7/1993 | (FR) . |
| 2091546 | 8/1982 | (GB) . |
| 2110524 | 6/1983 | (GB) . |
| 2292883 | 3/1996 | (GB) . |
| 6-277168 | 10/1994 | (JP) . |

* cited by examiner

*Primary Examiner*—Thomas M. Lithgow
(74) *Attorney, Agent, or Firm*—Alix, Yale & Ristas, LLP

(57) ABSTRACT

An improved vacuum cleaner having a removable dirt collector inside a substantially enclosed suction compartment is provided with a conditioning pack for deodorizing and/or disinfecting the stored waste matter even when the vacuum cleaner is not in operation. The conditioning pack is mounted on a fixture inside the suction compartment but outside the waste holder of the dirt collector. This arrangement facilitates more effective deodorization and/or disinfecting and, at the same time, easy emptying of waste matter from the dirt collector.

8 Claims, 5 Drawing Sheets

VACUUM CLEANER

FIELD OF THE INVENTION

The present invention relates generally to vacuum cleaners and, more particularly, to vacuum cleaners having a substantially enclosed suction compartment inside which there is provided a removable and substantially porous waste collector.

BACKGROUND OF THE INVENTION AND PRIOR ART

Vacuum cleaners are generally used for removing dirt, litter, rubbish, scraps or other items more generally referred to as waste matter. The waste matter removed is usually stored temporarily in a waste collector inside the vacuum cleaner but would remain in the vacuum cleaner until the waste collector is emptied. The duration of this temporary storage varies and depends on the actual use.

Because of the inherent nature of waste matter and the varieties of matter that would reside in the waste collector, it is not unusual that unpleasant smells develop and disseminate to the ambient air from the vacuum cleaner. It is also not unusual that waste matter could stay inside a vacuum cleaner for weeks or even months before a waste collector is emptied.

Where the stored waste matter comprise bacteria degradable materials or matter suitable for bacteria growth, the vacuum cleaner will quickly become a potential source of health hazards as well as unpleasant odours. The dissemination of harmful bacteria into the ambient air may be aggravated by the accelerated exhaust air-stream of the vacuum cleaner which helps to spread bacteria in confined areas.

U.S. Pat. No. 4,554,698 issued to Rennecker proposed the use of a scent dispensing arrangement for use with an upright vacuum cleaner to alleviate the unpleasant smells associated with a vacuum cleaner. This proposed arrangement, however, only provides fragrance conditioning to the downmost exhaust air stream on exit from the vacuum cleaner. Un-pleasant smells and bacteria could escape through the air-permeable dirt collecting bag adjunct to the vacuum cleaner well before they reach the exit.

U.S. Pat. No. 5,461,751 issued to Sepke proposed putting a odourising agent or pesticide containing porous"tea bag" inside the dirt collector to neutralise the unpleasant smells and as a pesticide. However, because such a conditioning "tea bag" is placed inside the dirt collector and buried among waste matter, it will be discarded everytime when the dirt collector is emptied even though the item itself is still useful. In addition, as the "tea bag" is usually buried well inside the dirt collector, only waste matter in its vicinity can be conditioned. Furthermore, because the "tea bag" is stored together with the waste matter which is usually very dirty, it could not be conveniently removed or replaced even if it is realised that the contents of the tea bag reacts undesirable with the waste matter or a different odourising agent is required to provide a satisfactory conditioning.

OBJECT OF THE INVENTION

It is therefore an object of the invention to provide an improved vacuum cleaner with means to at least partially neutralise the unpleasant odour released from the vacuum cleaner and/or to disinfect the stored waste matter to inhibit bacteria and germ growth inside the suction compartment while alleviating problems which are known to be associated with conventional vacuum cleaners having the aforementioned facilities. As a minimum, it is an object of the present invention to provide the public with an useful choice.

SUMMARY OF THE INVENTION

According to the present invention, there is provided a vacuum cleaner having a substantially enclosed suction compartment, a removable waste collector and an airconditioning means wherein the suction compartment includes first and second apertures respectively through which waste matter enters into and filtered air exits from said compartment, the waste collector comprises a substantially porous waste holder and an aperture for receiving waste matter entering through said first aperture, the waste collector is placed in the path joining said first and second apertures inside the said suction compartment; and the air-conditioning means comprises substances for conditioning the air inside said suction compartment.

With this improved vacuum cleaner, the waste matter stored inside the suction compartment will be treated by the conditioning means so that bacteria growth can be retarded, bad odours neutralised and/or insects killed regardless whether the vacuum cleaner is in operation. Thus, preferably, the air-conditioning means comprises means for dispensing deodorising, insect-killing and/or disinfecting substances.

Preferably, the air-conditioning means includes smell absorbing substances.

Preferably, the air-conditioning means comprises a mounting fixture for removably receiving said substances.

Preferably, the air-conditioning means is placed inside said suction compartment but outside said waste collector.

According to another aspect of the present invention, there is provided a vacuum cleaner having a substantially enclosed suction compartment, a removable waste collector and a pack of scented substances wherein the suction compartment includes first and second apertures respectively through which waste matter enters into and filtered air exits from said compartment, the waste collector comprises a substantially porous waste holder and an aperture for receiving waste matter entering through said first aperture, the waste collector is placed in the path joining said first and second apertures inside the said suction compartment; and the pack of scented substances disseminates fragrance inside said suction compartment and through said waste collector by convection.

BRIEF DESCRIPTION OF THE DRAWINGS

A preferred embodiment of the present invention will now be explained, by way of example and with reference to the accompanying drawings in which.

DETAILED DESCRIPTION OF THE PREFERRED EMBODIMENT

Figure 1:
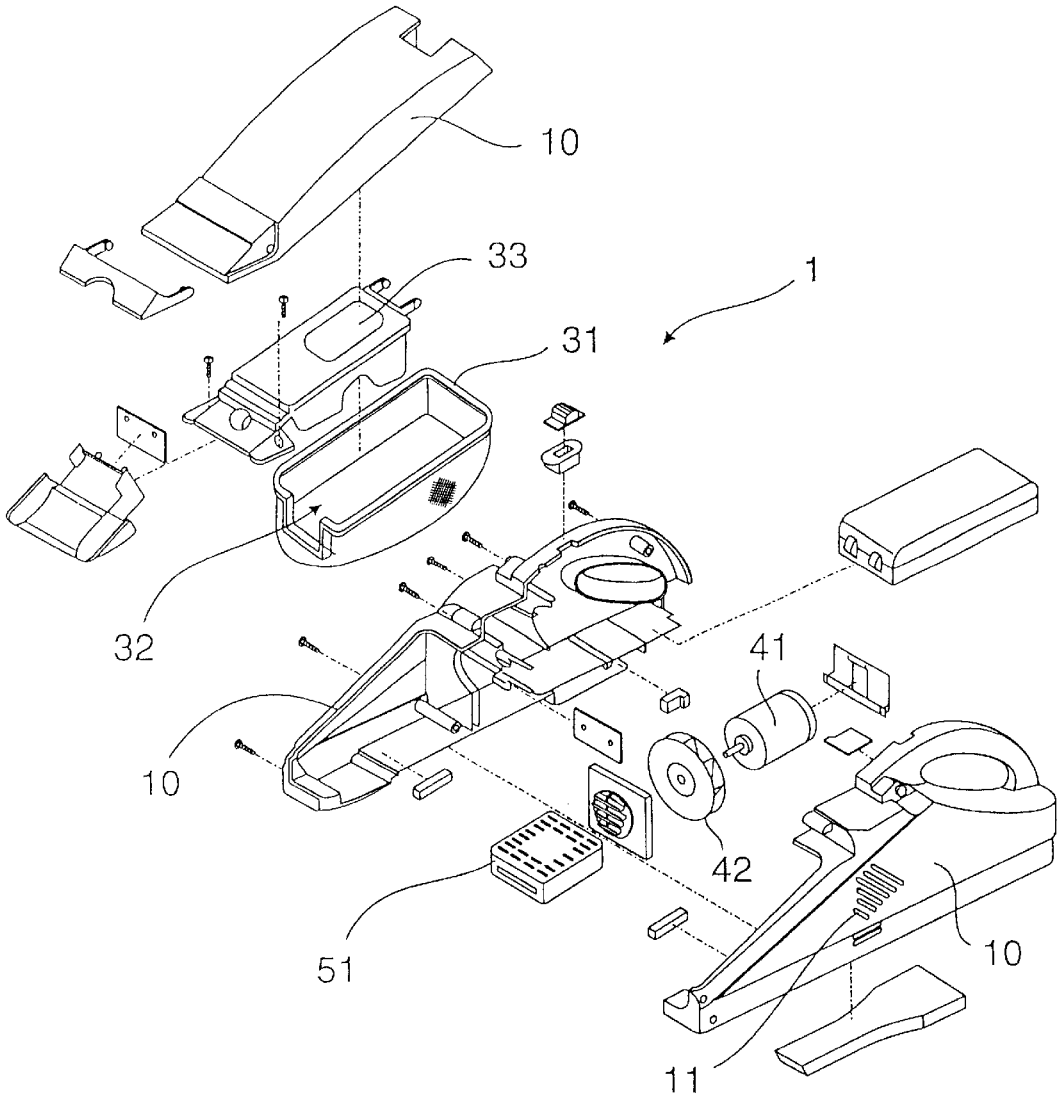
FIG. 1 shows the exploded view of a vacuum cleaner of a preferred embodiment of the present invention.
Figure 2:
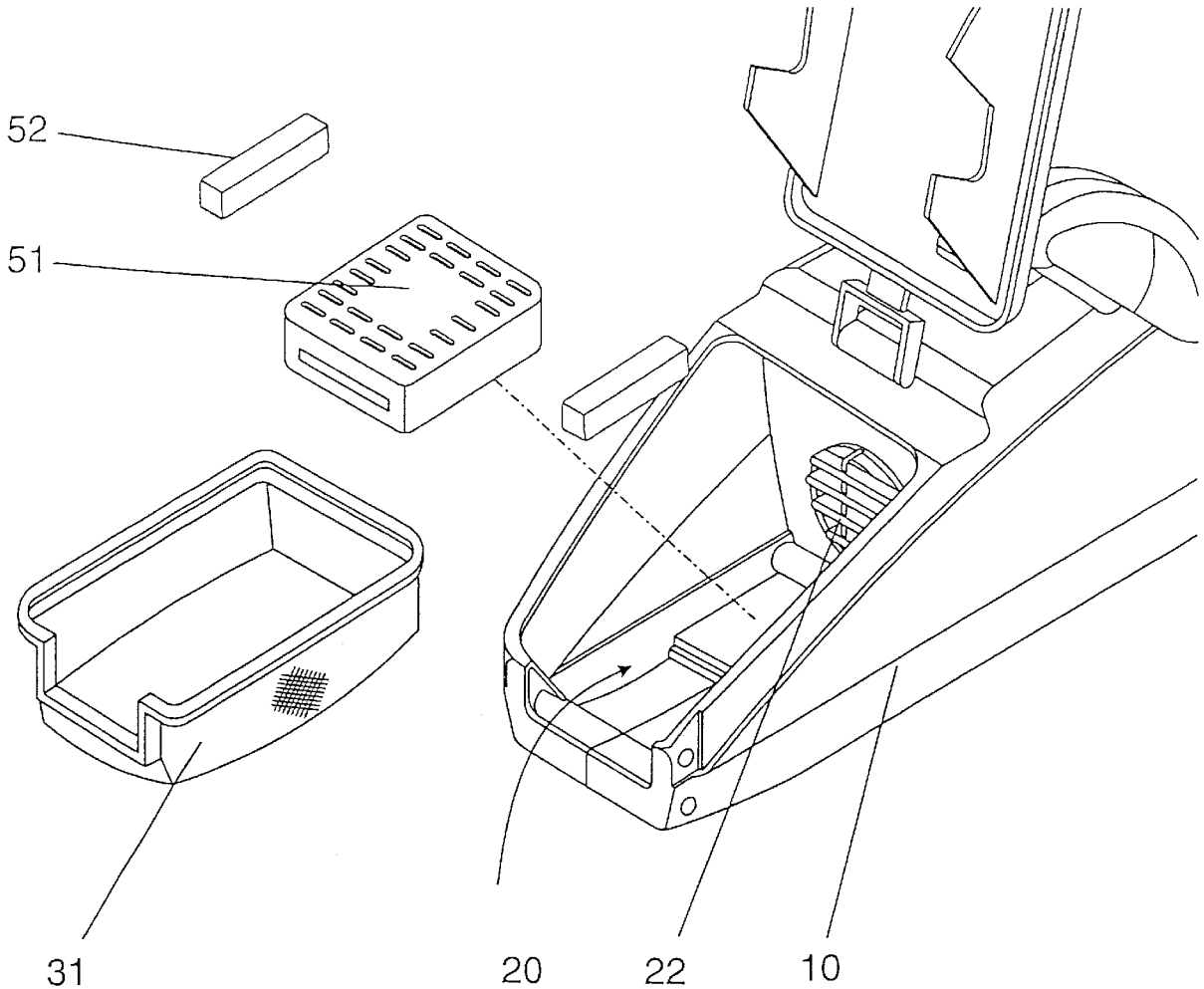
FIG. 2 is an exploded view of the suction compartment of the vacuum cleaner of FIG. 1.
Figure 3:
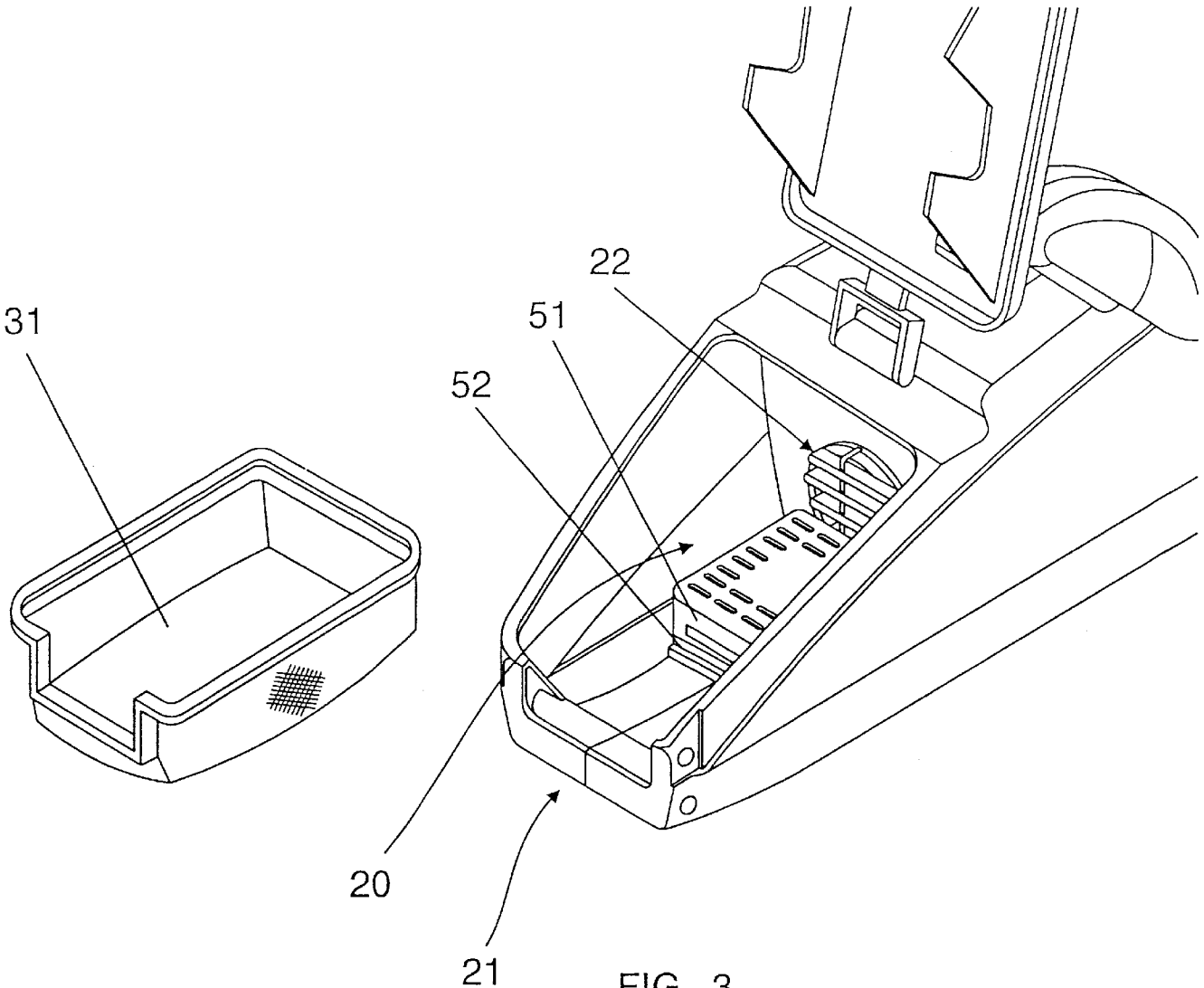
FIG. 3 is a partial exploded view of the suction compartment of the vacuum cleaner of FIG. 1 with the conditioning pack mounted and the dirt collector removed.
Figure 4:
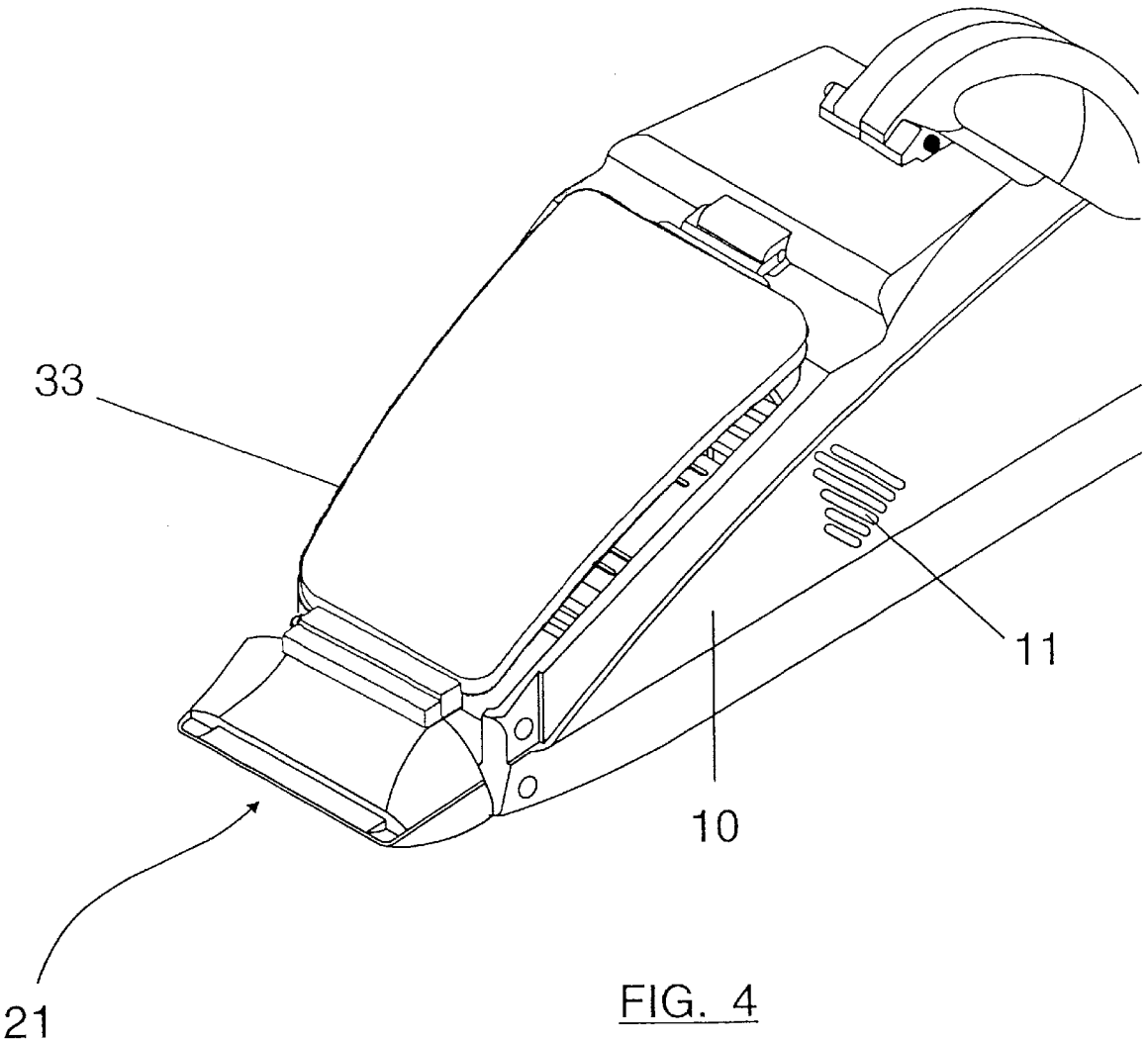
FIG. 4 shows the partial front view of the vacuum cleaner of FIG. 1 when the suction compartment is closed; and, FIG. 5 shows the longitudinal cross section of a vacuum cleaner of FIG. 1.
Figure 5:
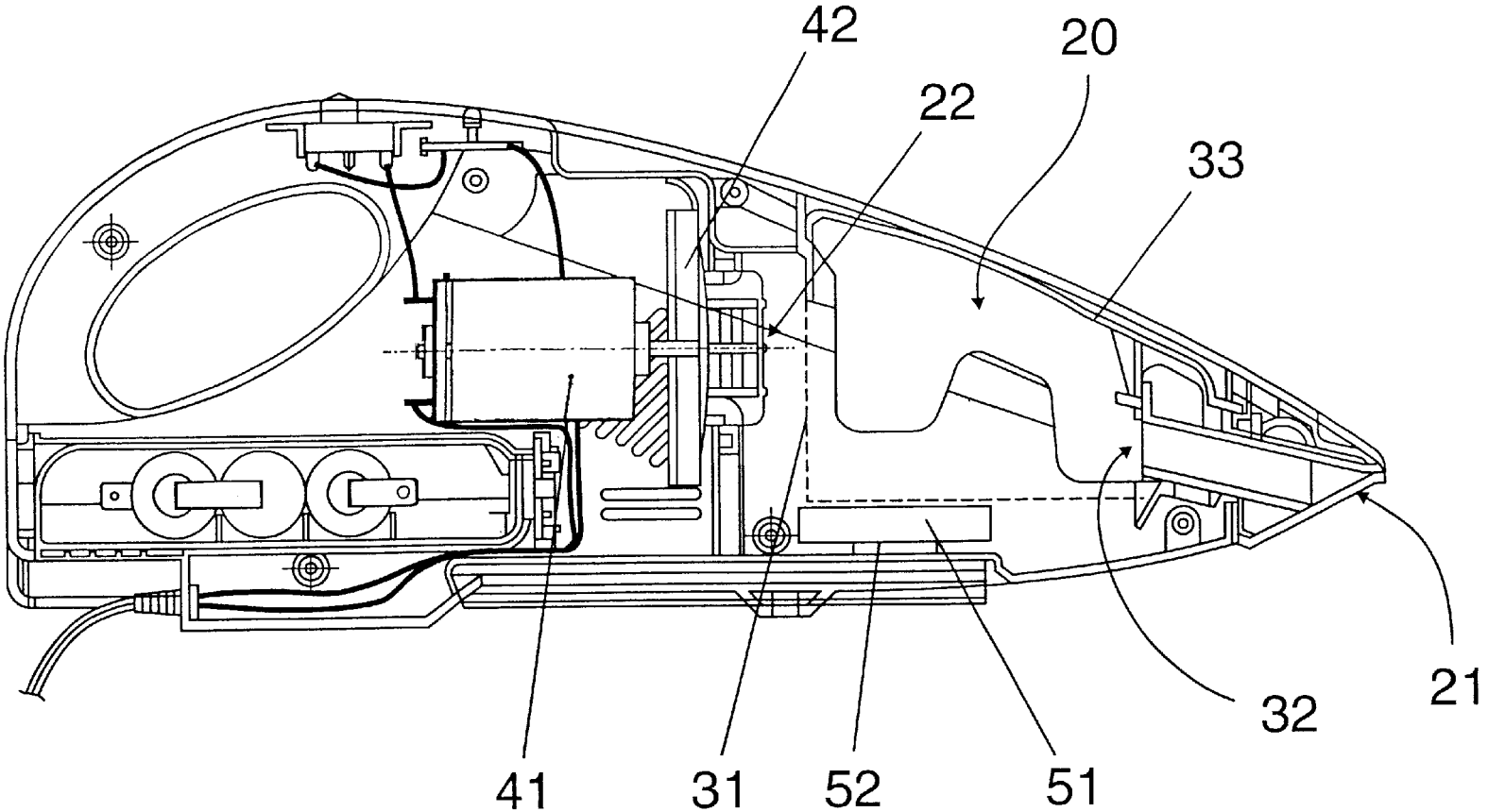

Referring to the Figures, there is shown a vacuum cleaner 1 embodying preferred features of the present invention. The vacuum cleaner 1 comprises a main housing 10 inside which there are provided a suction compartment 20, a waste collector 30, a suction generating device and a mounting fixture 52.

The suction compartment 20 is enclosed within the main housing 10 and is substantially air-tight apart from at least first 21 and second 22 apertures formed on its periphery. Accelerated air streams enter and leave the compartment respectively through the first and second apertures in response to suction generated by the suction generating means.

The first aperture is a nozzle 21 formed on one end of the suction compartment 20 through which a mixture of air and waste matter to be collected from the outside enters the main housing 10. The second 22 aperture is preferably, but not strictly necessarily, formed on the opposite end of the suction compartment 20 to provide an exit for filtered air to leave the compartment through, for example, exhaust holes on the main housing 10

The suction generating means comprises an electric motor with a propeller or fan 41 which is, in this example, placed adjacent to the second aperture so that air in the direct vicinity will be accelerated and forcefully extracted from the enclosed suction compartment 20 through the second 22 aperture when the motor runs at its rated speed. The rating of the electric motor is selected so that sufficient suction is produced at the first 21 aperture when the vacuum cleaner is in operation.

The waste collector 30 is placed inside the suction compartment 20 and in the path joining the first and second apertures. It comprises a porous filter, a waste holder 31 and a receiving aperture 32. The filter, usually made of paper, cloth or other suitable fabric materials, separates waste matter from the air-waste-matter mixture entering the vacuum cleaner and selectively, by the size of the filter pores, retains the waste matter in the holder 31. The waste holder 31 is for retaining filter blocked waste matter and is usually a bag or tray made of the same filter material. For most vacuum cleaners, the filter is combined with the waste holder 31 and there is usually no clear delineation between them.

To facilitate easy retrieval of the waste holder 31 from the vacuum cleaner for emptying or cleaning, the waste collector 30 in the present embodiment comprises a rigid detachable top cover 33 which is also hinged to the main housing 10. When the top cover 33 is detached from the waste collector 30, the waste holder 31 is exposed and a large aperture is left on the collector 30 so that waste matter could be easily removed. This is an improvement over conventional vacuum cleaners in which the cleaner has to be taken apart longitudinally before the waste holder 31 can be retrieved.

Inside the suction compartment 20, there is provided a removable air-conditioning pack 51 and a mounting fixture 52 for receiving the same. The conditioning pack may be a dispenser of fragrance or de-odourising agents to neutralise the unpleasant smell of the stored waste matter. As an alternative or as an additive to the fragrance, the conditioner may contain a suitable disinfectant to inhibit bacteria or germ growth inside the suction compartment 20. Instead of fragrance or disinfectant dispenser, the air-conditioning pack may contain odour absorbent to absorb unpleasant odours when the vacuum cleaner is not in operation.

The fixture 52 is a receiving structure with simple fastening means formed on the inside walls of the suction compartment 20 for releasably fastening the air-conditioner pack. Because the suction compartment 20 is substantially enclosed, forced air circulation within the compartment during operation will spread the fragrance or disinfectant throughout the stored waste matter and achieve deodorisation or disinfecting. The present arrangements also facilitate easy removal or replacement of the air-conditioning pack when this is necessary or beneficial.

When the vacuum cleaner is in operation, the suction generating means creates a partial vacuum inside the suction compartment 20. This causes outside air to accelerate towards the first aperture 21 and to enter the suction compartment 20. The accelerated air-streams are caused to circulate inside the compartment before exiting through the second aperture, at least partly because the waste collector is placed intermediate between the path joining the first and second apertures which helps to divert the air streams. This forced air circulation causes the fragrance or the disinfectant from the conditioning pack to disseminate throughout the suction compartment 20 and helps to penetrate them into the stored waste matter to promote the desirable odour-neutralising, insecticidal or disinfecting effects.

When the vacuum cleaner is not in operation, these odour-neutralising, insecticidal or disinfecting effects are then attained by diffusion or by natural absorption by the absorbents.

While the preferred vacuum cleaner shown in the Figures is a portable type, it should be clear that the above-mentioned preferred features apply equally well to other types vacuum cleaners having substantially closed suction compartment. Furthermore, although the invention has been described with reference to the above preferred embodiment, this is not to be considered limiting to the scope of the invention which is defined in the appended claims. Integers recited in the description are deemed to incorporate equivalents where appropriate to those skilled in the art to which the invention relates.

What is claimed is:

1. A vacuum cleaner having a substantially enclosed suction compartment disposed within a main housing, a removable waste collector and an air-conditioning means wherein:

said suction compartment includes first and second apertures respectively through which an air and waste matter mixture enters into and filtered air exits from said compartment, said waste collector comprises a substantially porous tray having a detachable top cover hinged to said main housing and an aperture for receiving said air and waste matter mixture entering the suction compartment through said first aperture, said waste collector is disposed in the path joining said first and second apertures inside said suction compartment and at least partially between said air-conditioning means and said second aperture; and said air-conditioning means comprises an air permeable container disposed inside said suction compartment and outside said waste collector, said container configured for removably receiving substances for conditioning the air inside said suction compartment and said container does not impede the flow of said air and waste matter mixture into said waste collector, wherein said top cover remains attached to said housing when said waste collector is removed.

2. A vacuum cleaner according to claim 1 wherein said air-conditioning means conditions the air inside said compartment regardless whether said vacuum cleaner is in operation.

3. A vacuum cleaner according to claim 1 wherein said air-conditioning means comprises means for dispensing deodorising, insect-killing and/or disinfecting substances.

4. A vacuum cleaner according to claim 1 wherein said air-conditioning means comprises smell absorbing substances.

5. A vacuum cleaner having a substantially enclosed suction compartment disposed within a main housing, a removable waste collector and a pack of scented substances wherein said suction compartment includes first and second apertures respectively through which an air and waste matter mixture enters into and filtered air exits from said compartment, said waste collector comprises a substantially porous tray having a detachable top cover hinged to said main housing and an opening for receiving said air and waste matter mixture entering through said first aperture, said waste collector is placed in a path joining said first and second apertures inside said suction compartment; and said pack of scented substances is removably disposed in a porous container affixed within said suction compartment and disseminates fragrance inside said suction compartment and through said waste collector by convection, wherein said porous container is located outside of said waste collector and said porous container does not impede the flow of said air and waste matter mixture into said waste collector.

6. A vacuum cleaner having a substantially enclosed suction compartment enclosed within a main housing of said vacuum cleaner, said suction compartment including first and second apertures, a removable waste collector comprising a substantially porous tray having an opening for receiving an air and waste matter mixture entering through said first aperture, said vacuum cleaner comprising:

a detachable top cover for said waste collector, said cover hinged to said main housing;

an air permeable container affixed to an inside surface of said suction compartment at a location exterior to said waste collector; and air-conditioning substances, wherein said top cover remains attached to said housing when said waste collector is removed and said air-conditioning substances are removably received in said air permeable container and condition air passing through said suction compartment and said container does not appreciably impede the progress of air through said suction compartment.

7. The vacuum cleaner of claim 6, wherein said air-conditioning substances are selected from the group consisting of: fragrances, deodorants, insecticides, disinfectants and anti-bacterials.

8. The vacuum cleaner of claim 6, wherein the air-conditioning substances condition air within said suction compartment regardless of whether air moves through said suction compartment.

* * * * *